US005224614A

United States Patent [19]

Bono et al.

[11] Patent Number: 5,224,614

[45] Date of Patent: Jul. 6, 1993

[54] NON-HANDLED LIGHTWEIGHT PLASTIC BOTTLE WITH A SUBSTANTIALLY RIGID GRIP DESIGN TO FACILITATE POURING WITHOUT LOSS OF CONTROL

[75] Inventors: James L. Bono; Louis Y. Gutting, both of Cincinnati; John E. Skidmore, Hamilton, all of Ohio

[73] Assignee: The Procter & Gamble Company, Cincinnati, Ohio

[21] Appl. No.: 832,532

[22] Filed: Feb. 7, 1992

[51] Int. Cl.[5] ..... B65D 1/42; B65D 23/10

[52] U.S. Cl. ..... 215/100 A; 215/1 C; 220/675; 220/771

[58] Field of Search ..... 215/10, 100 A; 220/675, 220/771; D9/535, 538, 540

[56] References Cited

U.S. PATENT DOCUMENTS

| | | | |
|---|---|---|---|
| D. 327,007 | 6/1992 | Olds | D9/520 |
| 2,013,243 | 3/1935 | Landon | 221/11 |
| 3,536,500 | 10/1970 | Cleereman et al. | 215/1 C X |
| 3,537,498 | 11/1970 | Amand | 215/1 C |
| 3,708,082 | 1/1973 | Platte | 215/1 C |
| 4,040,233 | 8/1977 | Valyi | 53/21 R |
| 4,122,142 | 10/1978 | Lawrence et al. | 264/97 |
| 4,359,165 | 11/1982 | Jakobsen | 215/1 C |
| 4,372,455 | 2/1983 | Cochran | 215/10 X |
| 4,375,442 | 3/1983 | Ota et al. | 264/25 |
| 4,446,969 | 5/1984 | Tyler | 220/675 X |
| 4,576,843 | 3/1986 | Beck et al. | 428/35 |
| 4,579,260 | 4/1986 | Young et al. | 222/465 R |
| 4,696,840 | 9/1987 | McCullough et al. | 220/462 |
| 4,755,404 | 7/1988 | Collette | 428/35 |
| 4,804,097 | 2/1989 | Alberghini et al. | 215/100 A |
| 4,805,799 | 2/1989 | Robbins, III | 220/403 |
| 4,856,685 | 8/1989 | Gaffney | 222/454 |
| 4,890,752 | 1/1990 | Ota et al. | 215/1 C |
| 4,969,922 | 11/1990 | Platte, Sr. | 215/1 C |
| 4,979,628 | 12/1990 | Robbins, III | 215/1 C |
| 4,982,868 | 1/1991 | Robbins, III | 220/404 |
| 4,982,869 | 1/1991 | Robbins, III | 220/404 |
| 4,993,565 | 2/1991 | Ota et al. | 215/1 C |
| 5,027,963 | 7/1991 | Robbins, III | 215/1 C |
| 5,054,632 | 10/1991 | Alberghini et al. | 215/1 C |
| 5,067,622 | 11/1991 | Garver et al. | 215/1 C |
| 5,103,988 | 4/1992 | Reil et al. | 215/100 A |
| 5,141,120 | 8/1992 | Brown et al. | 215/100 A X |
| 5,141,121 | 8/1992 | Brown et al. | 215/100 A |

FOREIGN PATENT DOCUMENTS

| | | | |
|---|---|---|---|
| 474542 | 6/1951 | Canada . | |
| 3123902 | 6/1982 | Fed. Rep. of Germany | 215/1 C |
| 1353643 | 1/1964 | France | 215/1 C |
| 87016 | 4/1966 | France | 215/1 C |
| 2025889 | 1/1980 | United Kingdom | 215/1 C |

*Primary Examiner*—Sue A. Weaver

*Attorney, Agent, or Firm*—E. Kelly Linman; Dean L. Garner

[57] ABSTRACT

A non-handled, flexible and lightweight plastic bottle for dispensing a liquid product, such as edible oils, by tilting the bottle along its vertical axis and pouring. The bottle has a flexible body with a rigid grip design. The grip design has a generally C-shaped cross-section when taken parallel to the bottle's vertical axis and an oblong cross-section when taken perpendicular to the bottle's vertical axis. The oblong cross-section of the grip area has a major axis parallel to its longest dimension and a minor axis parallel to its shortest dimension. The grip area has two parallel opposing beams parallel to the major axis which are inwardly indented. The two beams are joined in a closed circuit by two opposing arches, which are also inwardly indented but to a lesser extent. Each arch has a three-dimensional reinforcing means along its periphery from a point adjacent one beam to a point adjacent the opposing beam. The rigid grip design allows the user to grab the bottle with one hand while reducing the movement of the beams along the major and minor axis.

16 Claims, 5 Drawing Sheets

NON-HANDLED LIGHTWEIGHT PLASTIC BOTTLE WITH A SUBSTANTIALLY RIGID GRIP DESIGN TO FACILITATE POURING WITHOUT LOSS OF CONTROL

FIELD OF THE INVENTION

This invention relates to lightweight plastic bottles for storing and dispensing liquid products. As used herein the term "lightweight plastic bottle" refers to bottles wherein the ratio of the bottle's weight, as measured in grams, to the volume of the bottle's interior fluid containing chamber, as measured in fluid ounces, is equal to or less than unity.

BACKGROUND OF THE INVENTION

Liquid products such as edible oils are often packaged and sold in plastic bottles. Recently, in order to save natural resources there has been a desire to reduce the amount of plastic used to make these bottles. Furthermore, it is also desirable to make bottles that are more readily collapsible to reduce solid waste landfill volume. However, when the amount of plastic used to make a bottle is substantially reduced, the bottles typically become very flexible, to the point that they become bag-like and inconvenient to use and pour from without losing control.

When a plastic bottle contains a product such as an edible oil, the consumer usually grasps the bottle between their thumb and forefinger along the center of the bottle and tilts the bottle along its vertical axis to dispense discrete amounts of product. If the bottle is too flexible and relatively full of product when consumers grasp the bottle will deform, thereby reducing its internal volume and causing some amount of product to flow out of the bottle resulting in uncontrolled dispensing, oftentimes resulting in spilling and messiness. This makes the use of very thin plastic bottles for products such as edible oils impractical. To avoid the foregoing problems, consumers have generally shown a preference for bottles that are relatively rigid. Unfortunately, producing a prior art bottle rigid enough to have good handling and dispensing qualities directly conflicts with the desire t reduce the amount of material used to make the plastic bottle. Most commercially available plastic bottles for liquid consumer products such as edible oils typically have weight/volume ratio, measured in grams of plastic per fluid ounces of the interior liquid containing chamber, of 1.3 or higher. There has been a desire to make a lightweight plastic bottle for such products, which is defined above as a bottle having a weight-/volume ratio less than or equal to unity.

One method used in the past to reinforce flexible plastic bottles has been to place an outer shell of paperboard or like material around the flexible plastic bottle to reinforce it. Such containers are commonly referred to as bag-in-boxes. An example of a bag-in-box can be found in commonly assigned U.S. Pat. No. 4,696,840 issued to Skidmore et al. on Sep. 29, 1987. In a similar fashion one could simply place a band of paperboard or other substantially rigid material around the center of the flexible plastic bottle where the user normally grabs it. An example of such a device can be found in Canadian Patent No. 474,542 issued to Gushard on Jun. 19, 1951. Such packages, however, often require additional manufacturing steps, such as an assembly operation, which slows down production time and results in increased costs. Furthermore, these packages may pose environmental problems of their own. The bottles are made of two different materials requiring them to be separated before recycling. Separation may be impractical and/or inconvenient for the consumer.

Another method used in the past to help overcome dispensing problems associated with a flexible plastic bottle is to mold a handle section integral with the bottle itself. However, this solution also poses some drawbacks. For example, a handled bottle is inefficient in the amount of space that is needed to ship and store the bottle prior to use by the consumer. In addition, more material is normally needed. This can actually increase rather than decrease the use of the material and thereby increase the consumption of natural resources. Furthermore, handled bottles, for the most part, can only be manufactured using extrusion blow molding equipment. This normally limits the types of plastic that can be used. Polyethylene terepthalate (PET) is a preferred plastic material for making bottles for liquids not only because it is strong and durable, but also because it is relatively low in cost. Stretch blow molding a handled bottle comprised of PET normally requires two separate molding operations, one for the bottle and one for the handle. This can increase the cost of the bottle and result in increased production time.

One example of a non-handled plastic bottle used for sterile medical liquids can be found in U.S. Pat. No. 3,537,498 issued to Amand on Nov. 3, 1970. Amand discloses a rectangular bottle for sterile medical liquids, said bottle having indented wall sections, often referred to as a pinched-in waist, between the top and the bottom ends. The thickened pinched in waist shown in Amand curves inwardly to provide an indented channel completely encircling the bottle. This channel or pinched-in waist section is allegedly more rigid than the body of the bottle itself because of a combination of the indented geometry and the increased thickness in the pinched-in area. However, the bottle disclosed in the Amand patent is suggested for dispensing intravenous fluids by hanging the bottle upside down, not for dispensing liquids by tilting the bottle along its vertical axis and pouring. While the reinforcing technique disclosed by Amand may be sufficient for handling sterile medical liquids, particularly where the bottle's contents are not dispensed by pouring, it has been found that simply providing increased thickness to a pinched-in waist will not, by itself, give the bottle sufficient rigidity to facilitate mess-free pouring from a bottle liquids typically encountered in a kitchen environment such as cooking oil. Achieving a sufficient degree of rigidity normally requires that the grip area be made so thick that it defeats the purpose of using less plastic to make the remaining portions of the bottle, i.e., there is no appreciable saving in plastic when the entire bottle is weighed.

It is therefore the object of the present invention to provide a non-handled flexible plastic bottle with a unique substantially rigid grip area that overcomes the problems associated with the prior art bottles mentioned above.

It is another object of the present invention to provide such a bottle that is lightweight and therefore requires less material to produce.

It is another object of the present invention to provide such a plastic bottle having non-rigid portions which are readily collapsible, thereby reducing solid waste landfill volume.

It is another object of the present invention to provide such a plastic bottle that retains the basic functional features of a rigid bottle including openability, freshness protection, secure one-handed gripping and pouring, and reliable reclosure.

It is another object of the present invention to provide such a lightweight plastic bottle having a substantially rigid grip area that can be easily grabbed by one hand allowing the user to dispense small or discrete amounts of liquid easily and without loss of control due to collapse of the grip area.

It is another object of the present invention to provide such a lightweight plastic bottle having a substantially rigid grip area so that when the user squeezes the grip area, movement of the bottle towards its interior is substantially reduced and lateral movement of opposing portions of the grip area, relative to each other, is also substantially reduced.

The aforementioned and other objects of the invention will become more apparent hereinafter.

SUMMARY OF THE INVENTION

In accordance with the present invention there is provided a non-handled, flexible and lightweight plastic bottle for dispensing of a liquid product by tilting the bottle along its vertical axis and pouring without loss of control. The bottle comprises a closed bottom end, a closed top end having an orifice therein for dispensing the liquid product and a body portion connecting the top and bottom ends to one another. These collectively define an interior chamber for containing the liquid product. The bottle includes a substantially rigid grip area in the flexible body portion between the top and bottom ends. The grip area has a generally "C"-shaped cross-section, when viewed through the bottle's sidewall parallel to the bottles vertical axis, with the legs of the "C" extending outwardly away from the interior chamber. The grip area has an oblong cross-section, as measured perpendicular to the bottle's vertical axis. The grip area's oblong cross-section has a major axis aligned parallel to the longest dimension of the grip area's cross-section and a minor axis aligned parallel to the shortest dimension of the grip area's cross-section. The substantially rigid grip area further includes two opposing beams oriented substantially parallel to the major axis and indented towards the interior chamber of the bottle with respect to the body portion. The beams are preferably joined to one another by means of a pair of opposed arches. These arches connect the beams in a closed circuit and are also preferably indented towards the interior chamber of the bottle relative to the body portion, but to a lesser extent than the beams. Each of the arches has a substantially continuous three-dimensional reinforcing means along its periphery from a point adjacent one of the beams to a point adjacent the opposing beam. This reinforcement means in each of the arches substantially prevents movement of the beams toward the interior chamber along the minor axis and/or lateral shifting of the beams relative to one another along the major axis when the user grips the opposed beams between the thumb and an opposed finger of one hand. Because of the resistance to deformation of the grip area, the user can then comfortably grip the bottle with one hand and accurately dispense the liquid.

In one embodiment of the present invention the three-dimensional reinforcing means comprises a rib extending continuously along the periphery of each of the arches from a point adjacent one beam to a point adjacent the opposing beam.

In another embodiment of the present invention the three-dimensional reinforcing means comprises a series of discrete and closely spaced shaped protrusions extending along each arch from a point adjacent one beam to a point adjacent the opposing beam.

In yet another embodiment of the present invention, the series of shaped protrusions comprises two or more rows of diamond shaped protrusions.

BRIEF DESCRIPTION OF THE DRAWINGS

While the specification concludes with claims particularly pointing out and distinctly claiming the subject invention, it is believed that the same will be better understood from the following description when taken in conjunction with the accompanying drawings in which:

DETAILED DESCRIPTION OF THE INVENTION

Figure 1:
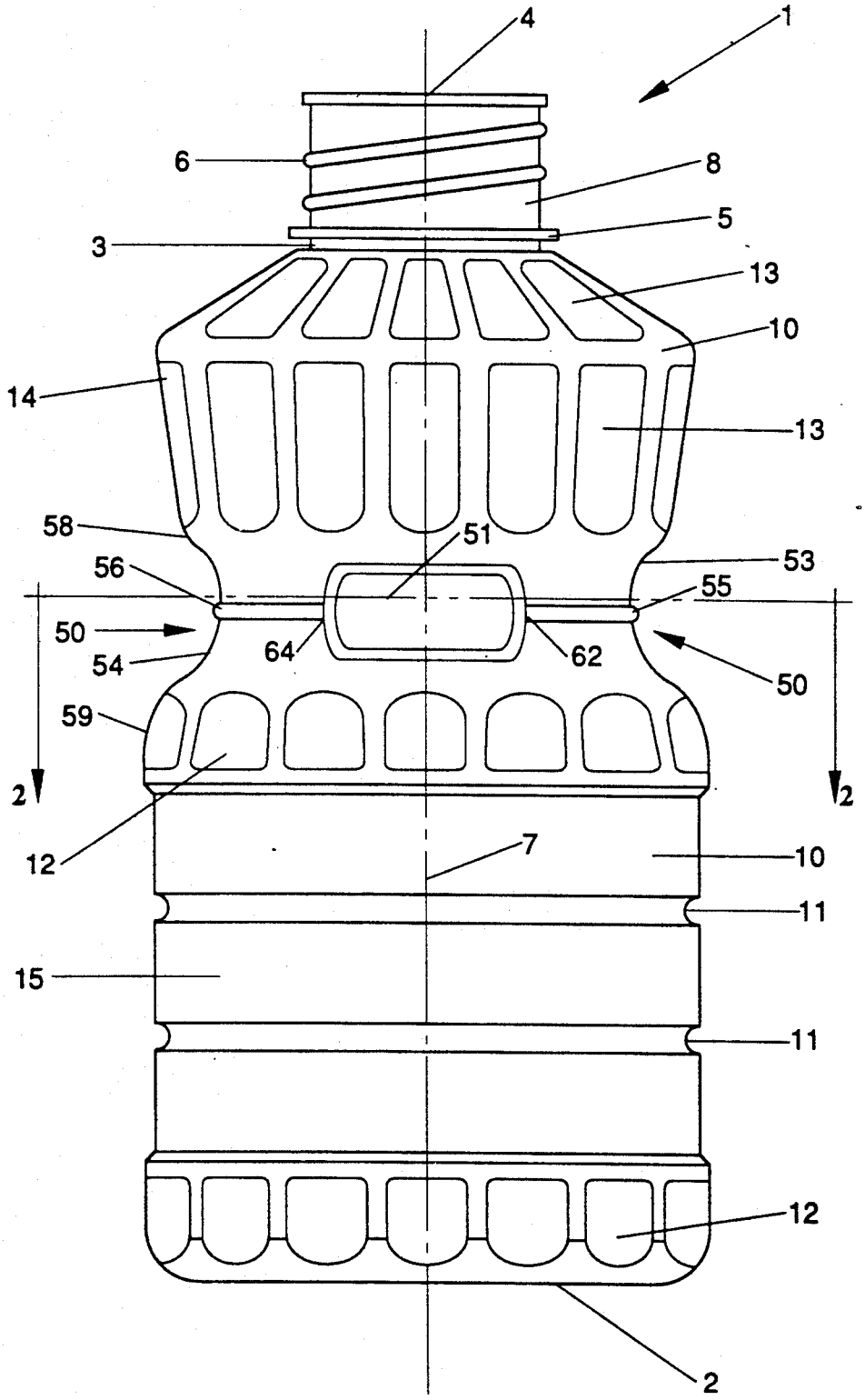
FIG. 1 is a front plan view of the bottle of the present invention.

Referring to the drawings wherein like numerals indicate the same element throughout the view there is shown in FIG. 1 a bottle 1 for dispensing liquid products. Bottle 1 has a closed bottom end 2, a closed top end 3 having an orifice 4 for dispensing a liquid product. The bottle further includes a flexible body portion 10 connecting the top 3 and bottom 2 to one another. The top end 3, bottom end 2 and flexible body portion 10 collectively define an interior chamber 5 (shown in FIG. 2) for containing a liquid product. The bottle further includes a substantially rigid grip area 50 in the flexible body portion 10 intermediate the top 3 and bottom 2. The liquid in the bottle is dispensed by tilting the bottle 1 along its vertical axis 7 and pouring.

Body portion 10 also has a number ornamental depressions 12 and 13. While some modicum of added rigidity might be obtained through these depressions, their main purpose is for decoration. Furthermore, the body portion 10 has inwardly indented ribs 11 below the grip area 50. These ribs give some added rigidity to the bottle. However, the body portion remains substantially flexible and deformable when handled even with the ribs 11.

Top 3 of bottle 1 has neck 8 adapted to receive a cap so as to seal orifice 4 and prevent any unwanted leakage of product therethrough when not in use. Neck 8 has external threads 6 for receiving an internally threaded cap. Neck 8 further includes a ledge 5 extending around the periphery of neck 8. Ledge 5 helps to further seal the cap/neck interface. It is preferred that neck 8 be substantially rigid so as to receive a substantially flexible cap. This helps to ensure an adequate seal of orifice 4. Furthermore, bottom 2 is preferably rigid so as to give stability to bottle 1 so that it stays in its upright position when not in use, as shown in FIG. 1.

Bottle 1 of the present invention is typically constructed by stretch blow molding polyethylene terepthalate (PET). The stretch blow molding technique generally leaves the body portion 10 of bottle 1 thicker towards the top end 3 and thinner towards bottom end 2. This tends to make the top section 14 of the body portion 10 above grip area 50 somewhat more rigid than the bottom section 15 of body portion 10 below grip area 50. Moreover, indented sections, such as grip area 50, will also be thicker than the unindented sections immediately adjacent to it. As will be appreciated by those of ordinary skill in the plastic bottle molding art, these thickness distributions occur due to inherencies which are present in the stretch blow molding process.

Other methods such as extrusion blow molding or injection molding may also be suitable for manufacturing the bottle of the present invention. These alternative methods of manufacturing may result in a thickness distribution across the bottle which is somewhat different than that produced by stretch blow molding. Nonetheless, it is believed that the objects of the present invention are achieved primarily as a result of certain geometrical modifications made to the bottle, as discussed below, rather than to the particular process employed to produce the bottle.

Figure 2:
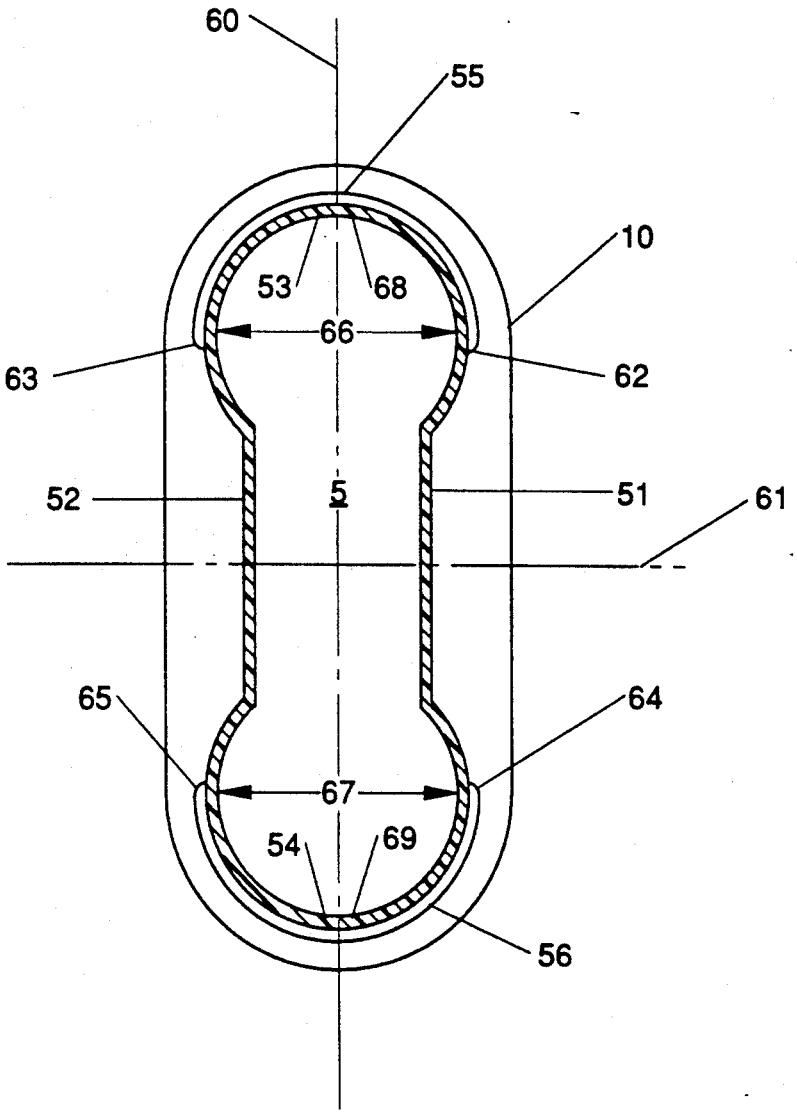
FIG. 2 is a top sectional view taken along line 2—2 of FIG. 1.

A unique feature of the bottle 1 is the grip area 50, which can best be described by referring to FIGS. 1 and 2. FIG. 2 is a top sectional view taken along section line 2—2 of FIG. 1. The bottle side wall in grip area 50 has a "C" shaped cross-section when viewed parallel to the bottles vertical axis 7. The legs of the "C" extend outwardly from the interior chamber 5 where they are connected to body portion 10. Grip area 50 is substantially rigid so that the user can easily grip the bottle along the grip area and dispense small or discrete amounts of liquid without causing the grip area to deform to any appreciable extent.

Grip area 50 has an oblong cross-section when measured perpendicular to the bottle's vertical axis. Grip area 50 has a major axis 60 aligned parallel to the longest dimension of the grip area's cross-section and a minor axis 61 aligned parallel to the shortest dimension of the grip area's cross-section. Grip area 50 comprises two parallel and opposing beams 51 and 52. These beams can be gripped by the consumer between the thumb and a finger of one hand in order to dispense liquid from the bottle. Beams 51 and 52 are inwardly indented towards the interior chamber 5 relative to body portion 10. Beams 51 and 52 are connected to each other in a closed circuit by two opposed arches 53 and 54. Arches 53 and 54 are also indented towards the interior 5 of bottle 1 relative to body portion 10, but to a lesser extent than beams 51 and 52. Arches 53 and 54 need not have an entirely curved configuration and may even have a substantially linear configuration from points 62 and 64 to beam 51 and from points 63 and 65 to beam 52.

Each of the arches has a three-dimensional reinforcing means along its periphery from a point adjacent one beam to a point adjacent the other beam. In one embodiment of the present invention, shown in FIGS. 1 and 2, this three-dimensional reinforcing means comprises ribs 55 and 56 extending continuously along arches 53 and 54, respectively, from a point adjacent one beam to a point adjacent the other beam. Rib 55 extends continuously along the periphery of arch 53 from point 62, adjacent beam 51, to point 63, adjacent beam 52. Similarly, Rib 56 extends continuously along the periphery of arch 54 from point 64, adjacent beam 51, to point 65, adjacent beam 52. Ribs 55 and 56 need not protrude outwardly, as seen in FIGS. 1 and 2, but may be inwardly directed or indented ribs similar to ribs 11 in body portion 10.

It has been learned in the practice of the present invention that the addition of a three-dimensional reinforcing means along arches 53 and 54 substantially increases the rigidity of the grip area 50. A user typically grabs the bottle with one hand by placing their thumb on one of the beams 51,52 and placing an opposing finger, such as the index finger, on the opposite beam. The combination of the beams 51,52, the arches 53,54 and the three-dimensional reinforcing means 55,56 has been found to not only reduce the movement of beams 51 and 52 towards the interior chamber 5 along lines parallel to minor axis 61 when the user exerts enough pressure between their thumb and finger to lift and pour from the bottle, but also to reduce the lateral shifting movement of beams 51 and 52, relative to each other, along lines parallel to the major axis 60. As a result, the user's action in lifting and pouring from the bottle does not cause any appreciable deformation of the substantially rigid grip area 50. This enables the user to maintain complete control of the pouring operation in a manner similar to substantially rigid bottles. The addition of the three-dimensional reinforcing means does not interfere with the user's ability to comfortably grip beams 51 and 52 between the thumb and a finger of one hand and dispense liquid from the bottle by pouring.

Another embodiment of the three-dimensional reinforcing means of the present invention, comprises providing a series of closely spaced, shaped protrusions which extend across the periphery of each arch from a point adjacent one beam to a point adjacent the other beam. An example of this embodiment can be seen in FIG. 3 where there is shown bottle 101. Bottle 101 has grip area 150 comprising beams 151 and 152 (not shown) connected to each other in a closed circuit by arches 153 and 154. Arches 153 and 154 have a three-dimensional reinforcing means comprising a series of closely spaced, discrete diamond shaped protrusions 170. The diamond shaped protrusions 170 extend across the peripheries of arches 153 and 154 from points 162 and 164 adjacent beam 151 to points 163 and 165 (not shown) to beam 152 (not shown).

Figure 5:
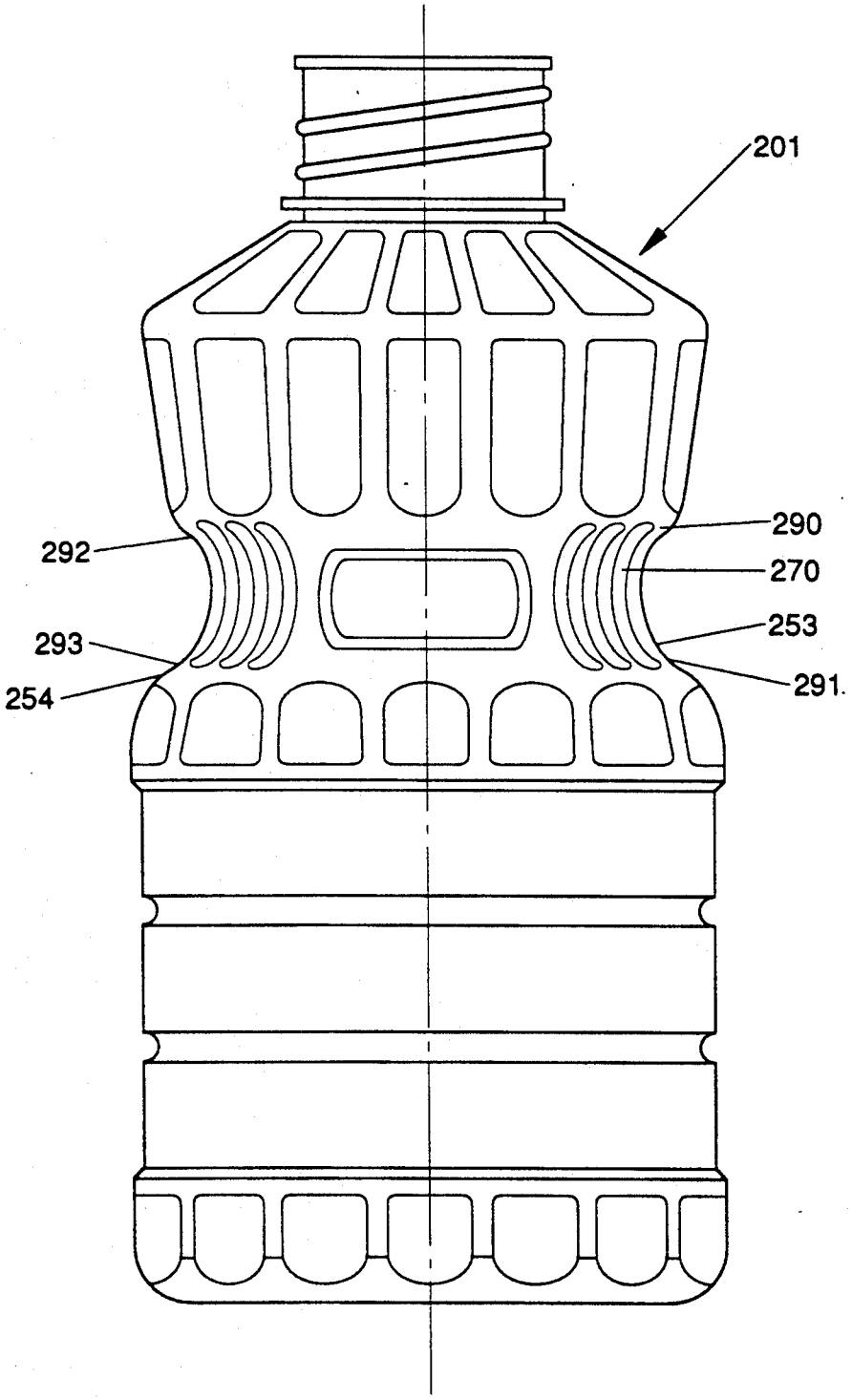
FIG. 5 is a front plan view of an alternative embodiment of the bottle of the present invention.

FIG. 5 shows another embodiment of the present invention wherein the three-dimensional reinforcing means comprises a series of closely spaced, inwardly directed, shaped protrusions. FIG. 5 shows bottle 201 having arches 253 and 254. The three-dimensional reinforcing means for arches 253 and 254 comprises vertically extending indented ribs 270. Ribs 270 are closely spaced from each other and extend from the top 290 to the bottom 291 of arch 253 and from top 292 to the bottom 293 of arch 254.

In a preferred embodiment of the present invention the three-dimensional reinforcing means of the present invention has a continuous and uninterrupted configuration. Ribs 55 and 56 of bottle 1 shown in FIG. 1 is an example of a continuous three-dimensional reinforcing means. That is they are continuous and uninterrupted from point 62 to point 63 and from point 64 to point 65. The continuity of ribs 55 and 56 make the arches 53 and 54 substantially free of stress concentrating points along their periphery where the reinforcing means is present. That is when the bottle is squeezed in such a way that beams 51 and 52 attempt to move inwardly towards each other, arches 53 and 54 tend to resist pinching or buckling at points along their peripheries. Such points can be referred to as stress concentrating points or pinch points. It is believed that the addition of the continuous and uninterrupted three-dimensional reinforcing means minimizes the chance that stress concentrating points will be formed along the arches. It is further believed that the avoidance of such stress concentrating points in the arches substantially reduces the ability of the beams 51 and 51 to move towards the interior chamber 5 along lines parallel to the minor axis 61 when the bottle is squeezed. This movement is reduced to a greater extent than with a discontinuous and interrupted three-dimensional reinforcing means such as the vertically extending indented ribs 270 of bottle 201 shown in FIG. 5.

Figure 4:
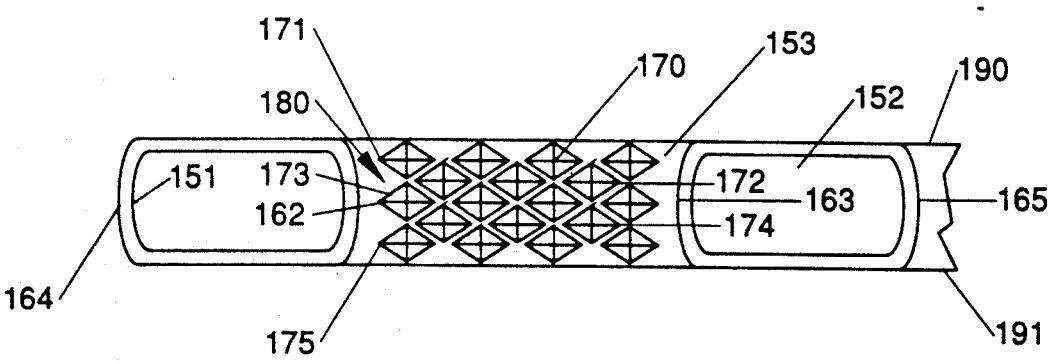
FIG. 4 is a partial plan view of the development of grip area 150 of bottle 110 from points 164 to 165.

It is believed that the diamond shaped protrusions 170 of bottle 101 also help to prevent the aforementioned stress concentrating points along arches 153 and 154 if placed in a continuous and uninterrupted configuration. This configuration can best be described by referring to FIG. 4 where there is shown a partial flat plan view of the development of arch 153 of grip area 150 of bottle 101. Arch 153 has five rows of diamond shaped protrusions 171, 172, 173, 174 and 175 between top 190 and bottom 191 of arch 153. By taking any two nested rows or a pair of rows consisting of one odd and one even numbered row one can see how the rows of protrusions substantially prevent the formation of stress concentrating points along arch 153. Take for example rows 172 and 173 which extend from point 162 adjacent beam 151 to point 163 adjacent beam 152. The configuration of rows 172 and 173 is such that at any point from 162 to 163, arch 153 has at least one protrusion present from the top 190 of arch 153 to bottom 191. This makes the three-dimensional reinforcing means continuous and uninterrupted and substantially eliminates the formation of stress concentrating points from point 162 to point 163. Rows 172 and 173 together essentially create a rib 180, which functions in a manner similar to continuous horizontally extending ribs 55 and 56 of bottle 1.

Figure 3:
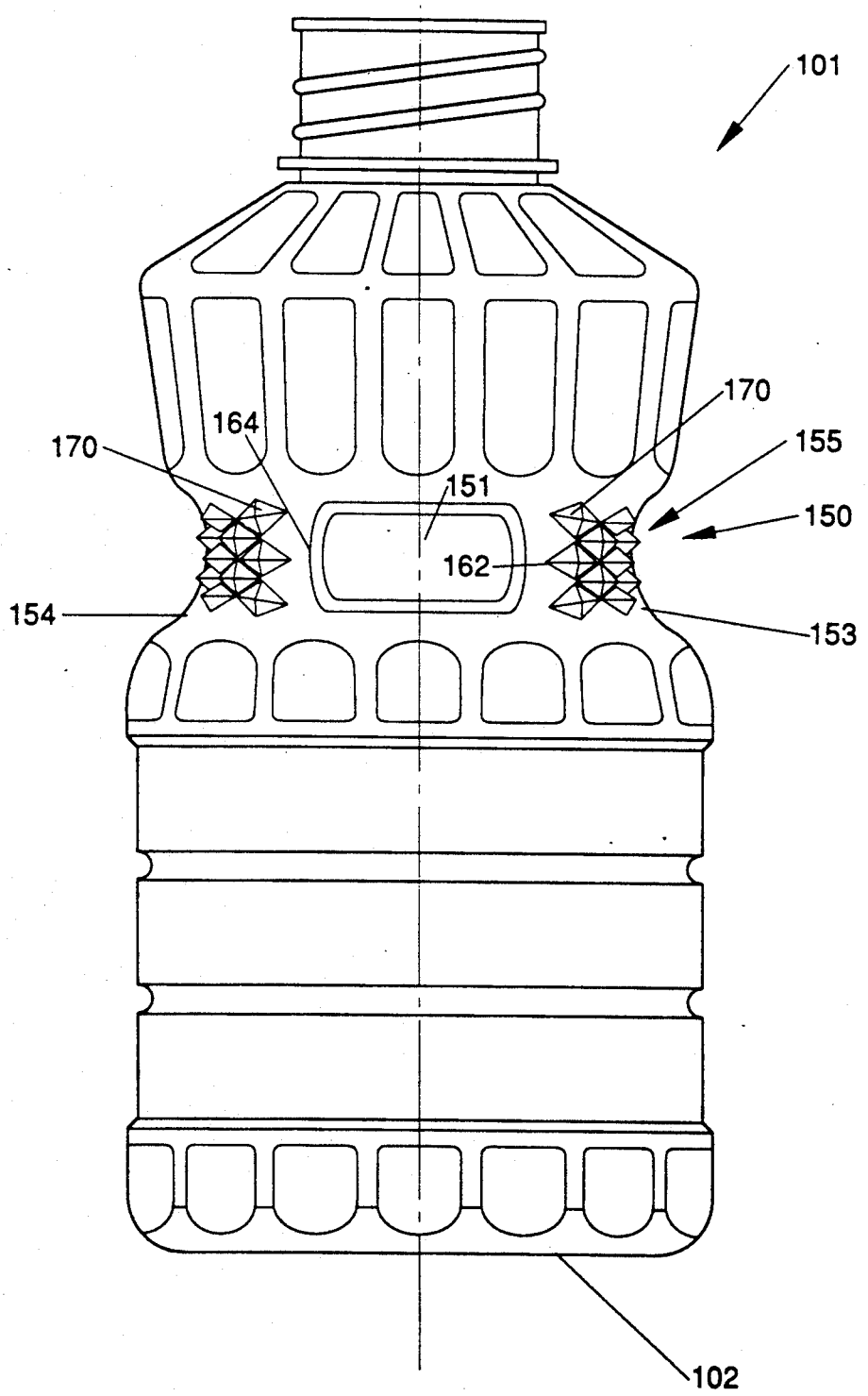
FIG. 3 is a front plan view of a preferred embodiment of the bottle of the present invention.

The diamond shaped protrusions 170 of bottle 101 were chosen due to their ornamental design but other shaped discrete protrusions could be used to achieve substantially the same result. Furthermore, the protrusions need not protrude outwardly, as shown in the embodiment of FIG. 3, but may protrude inwardly to take the form of indentations.

It is believed that the desired substantial rigidity of the grip area 50 of the present invention is obtained primarily through the geometric features described above. However, it is recognized that some additional rigidity may also be obtained by making the grip area 50 slightly thicker than the flexible body portion 10. Depending on the particular method of manufacture, this may be inherent. For example, the grip area 50 will become slightly thicker than the body portion 10 located below the grip area 50 when the bottle is made by stretch blow molding. However, it is believed that the objects of the present invention are primarily obtained by the geometrical constraints described above. The increased thickness which may inherently result from the manufacturing process chosen is not normally sufficient to produce a substantially rigid grip area in a lightweight plastic bottle of the type described herein. If the grip area is made sufficiently thick to give the grip area the desired substantial rigidity without simultaneously satisfying the geometric parameters specified herein, the amount of plastic required is normally so great that the bottle is no longer considered lightweight. In this regard, it is preferred that the ratio of the bottle's weight, as measured in grams, to the volume of the interior chamber 5 of the bottle, as measured in fluid ounces, be equal to or less than unity. In a particularly preferred embodiment this ratio is between about 0.6 and about unity.

In order to provide secure one handed gripping and pouring while at the same time maintaining the desired rigidity, preferred dimensions for certain features of the bottle have been developed. By referring to FIG. 2 one can see diameter 66 of arch 53 and diameter 67 of arch 54. Diameters 66 and 67 are the largest diameters of arches 53 and 54 measured parallel to the major axis 60. It has been found that for secure one handed gripping and pouring, the diameters 66 and 67 should be less than about 2.0 inches and most preferably between about from 1.5 and about 2 inches. This range will accommodate a wide variety of human hand sizes. For non-directionality, it is also preferable that the bottle be symmetrical and, therefore, diameters 66 and 67 will most preferably be equal to each other.

In order for the user's thumb to easily rest on one of the beams 51,52 it is preferable that the distance (shown in FIG. 2) from the outermost tip 68 of arch 53 to the outermost tip 69 of arch 54 be in the range of about 2.5 to about 5.0 inches and most preferably be in the range of from about 2.75 to about 3.25 inches. Furthermore, the dimensions of the beams be 51,52 should be such that they fit the user's thumb for a wide range of people. In this regard, it is preferred that the length of the beams as measured parallel to the major axis 60 be from about 1.0 to about 2.0 inches and most preferably from about 1.3 to about 1.7 inches. It is also preferred that the height of the beams, as measured parallel to the bottle'-vertical axis 7 be from about 0.8 to about 1.2 inches, and most preferably be from about 0.9 to about 1.1 inches. These ranges of dimensions will comfortably accommodate a wide variety of human thumb sizes.

The distance between beams 51 and 52, when measured parallel to the minor axis 61, may be limited by the manufacturing technique used. Generally, the smaller this distance the more rigid the grip area becomes.

For stretch blow molding a bottle of polyethylene terepthalate (PET) having a gripping area 50 within the range of dimensions mentioned above, the resulting distance between beams 51 and 52, as measured parallel to minor axis 61, has been found to be in the range of about 0.9 to about 1.5 inches.

To impart the desired substantial rigidity to gripping area 50 it has also been found that the linear distance between an arch 53 or 54 and the body portion 10, measured in a plane perpendicular to the bottles vertical axis 7, is at least about 0.3 inches, and most preferably, at least about 0.4 inches. The greater this distance the more rigid the grip area 50 will become, however, as this distance increases more material is needed. Thus, the particularly preferred ranges described above represent a balance between the need for substantial rigidity and the desire to use less plastic. In the manufacture of the bottle the distance between an arch 53,54 and the body 10 may vary somewhat across the peripheries of the arches.

The length of grip area 50 from its top 58 to its bottom 59, shown in FIG. 1, is preferably in the range of from about 0.75 to about 1.5 inches, and most preferably from about 0.9 to about 1.2 inches.

Once the particular dimensions of the grip area 50 have been selected, different size lightweight plastic bottles having different volumes may be made by making the bottle longer, that is increasing the distance of the bottle from its top 3 to its bottom 2 without compromising the user's ability to pour from it without losing control.

While particular embodiments of the present invention have been illustrated and described, various modifications will be apparent to those skilled in the art without departing from the spirit and scope of the present invention. It should be noted that the ranges of the dimensions given above are the preferred ranges but are not necessary to practice the present invention. One could construct a bottle having dimensions outside the ranges given above but still be within the scope of the present invention. Accordingly, the scope of the present invention should be considered in terms of the following claims and is understood not to be limited to the details described and shown in the specification and drawings.

What is claimed is:

1. A non-handled flexible and lightweight plastic bottle for dispensing a liquid product by tilting said bottle along its vertical axis and pouring, said bottle comprising:

(a) a closed bottom end, a closed top end having an orifice therein for dispensing said liquid product, and a flexible body portion connecting said top and bottom ends to one another, said top end, said bottom end and said flexible body portion collectively defining an interior chamber for containing said liquid product; and (b) a substantially rigid grip area in said flexible body portion intermediate said top and bottom ends, said grip area having a generally C shaped cross-section when taken parallel to said bottle's vertical axis with the legs of said C extending away from said interior chamber and being connected to said body portion, said grip area having an oblong cross-section as measured perpendicular to said bottle's vertical axis, said oblong cross-section of said grip area having a major axis aligned parallel to the longest dimension of said grip area's oblong cross-section and a minor axis aligned parallel to the shortest dimension of said grip area's oblong cross-section, said substantially rigid grip area further comprising:

(1) two opposing beams parallel to said major axis, said beams being indented towards said interior chamber of said bottle with respect to said body portion;

(2) said beams being joined to one another by means of a pair of opposed arches, said arches connecting said beams in a closed circuit, said arches also being indented towards said interior chamber of said bottle relative to said body portion, but to a lesser extent than said beams;.and (3) each of said arches having a three-dimensional reinforcing means along its periphery from a point adjacent one of said beams to a point adjacent said opposed beam to strengthen said arches and add rigidity to said grip area, whereby the combination of said beams, said arches and said three-dimensional reinforcing means substantially prevents both movement of said beams towards the interior chamber along lines parallel to said minor axis and lateral movement of said beams relative to each other along lines parallel to said major axis so that the user can grip the opposed beams between the thumb and an opposed finger of one hand and pour liquid through the orifice of said bottle without losing control.

2. The bottle of claim 1 wherein said three-dimensional reinforcing means is continuous and uninterrupted along each of said arches' peripheries from a point adjacent one of said beams to a point adjacent said opposing beam, such that said arches are substantially free from stress concentrating points along their peripheries.

3. The bottle of claim 2 wherein said continuous and uninterrupted three-dimensional reinforcing means is a rib extending along each of said arches' peripheries from a point adjacent one of said beams to a point adjacent said opposing beam.

4. The bottle of claim 2 wherein said continuous and uninterrupted three-dimensional reinforcing means comprises at least two nested rows of diamond shaped protrusions extending along each of said arches' peripheries from a point adjacent one of said beams to a point adjacent said opposing beam.

5. The bottle of claim 2 wherein said three-dimensional reinforcing means comprises a series of closely spaced shaped protrusions which extends along said arches' peripheries from a point adjacent one said beam to a point adjacent said opposing beam.

6. The bottle of claim 5 wherein said series of shaped protrusions comprises discrete diamond shaped protrusions.

7. The bottle of claim 5 wherein said series of closely spaced shaped protrusions comprise a plurality of indented vertical ribs.

8. The bottle of claims 1 or 2 wherein said bottom end is substantially rigid.

9. The bottle of claims 1 wherein said top end has a neck section with said orifice on its top, said neck section being substantially rigid and having threads so as to be adapted to receive a threaded cap to seal said orifice.

10. The bottle of claims 1 or 2 wherein said bottle is comprised of polyethylene terepthalate.

11. The bottle of claims 1 or 2 wherein said maximum diameter of said arches, as measured parallel to said minor axis is less than 2 inches.

12. The bottle of claims 1 or 2 wherein the height of said beams, measured parallel to said bottles vertical axis, is greater than or equal to 1.0 inches and less than or equal to 2.0 inches, and wherein the length of said beams, measured parallel to said major axis, is greater than or equal to 0.8 inch and less than or equal to 1.2 inches.

13. The bottle of claim 1 or 2 wherein the greatest distance from one said arch to said opposing arch, measured parallel to said major axis, is greater than or equal to 2.5 inches and less than or equal to 5.0 inches.

14. The bottle of claims 1 or 2 wherein said distance from said arches to said body portion, measured parallel to said minor axis, at any point along said arches periphery is greater than 0.4 inches.

15. The bottle of claims 1 or 2 wherein said length of said grip area, measured parallel to said vertical axis, is greater than or equal to 0.75 inches and less than or equal to 1.5 inches.

16. A non-handled flexible and lightweight bottle, stretch blow molded from polyethylene terepthalate, said bottle adapted for dispensing a liquid product by tilting said bottle along its vertical axis and pouring, said bottle comprising:

(a) a substantially rigid closed bottom end and a closed top end having a substantially rigid neck section with an orifice therein for dispensing said liquid product, said neck section having threads so as to be adapted to receive a cap to seal said orifice, said bottle further comprising a flexible body portion connecting said top and bottom ends to one another, said top end, said bottom end and said flexible body portion collectively defining an interior chamber for containing said liquid product; and (b) a substantially rigid grip area in said flexible body portion intermediate said top and bottom ends and thicker than said body portion, said grip area having a generally C-shaped cross-section when taken parallel to said bottles vertical axis with the legs of said C extending away from said interior chamber and being connected to said body portion, said grip area having an oblong cross-section as measured perpendicular to said bottle's vertical axis, said cross-section of said grip area having a major axis aligned parallel to the longest dimension of said grip area's oblong cross-section and a minor axis aligned parallel to the shortest dimension of said grip area's oblong cross-section. said substantially rigid grip area further comprising:

(1) two opposing beams parallel to said major axis, said beams being indented towards said interior chamber of said bottle with respect to said body portion;

(2) said beams being joined to one another by means of a pair of opposed arches, said arches connecting said beams in a closed circuit, said arches also being indented towards said interior chamber of said bottle relative to said body portion, but to a lesser extent than said beams; and (3) each of said arches having a three-dimensional continuous reinforcing means extending along its periphery from a point adjacent one of said beams to a point adjacent said opposing beams, said reinforcing means comprising two or more nested rows of discrete closely spaced diamond shaped protrusions, said three-dimensional reinforcing means strengthening and and adding rigidity to said arches, whereby the combination of said beams, said arches and said three-dimensional reinforcing means is such that when the user grips the opposed beams with one hand, movement of said beams towards the interior chamber along lines parallel to said grip areas minor axis is substantially reduced, and lateral movement of said beams, relative to each other, along lines parallel to said grip areas major axis is also substantially reduced, whereby the user can comfortably grip said bottle with one hand and accurately dispense said liquid.

* * * * *